United States Patent [19]

Jaeger

[11] 4,113,107

[45] Sep. 12, 1978

[54] MACHINE GUN RACK

[76] Inventor: Dennis A. Jaeger, R.R. 1, Strandburg, S. Dak. 57265

[21] Appl. No.: 848,012

[22] Filed: Nov. 2, 1977

[51] Int. Cl.[2] ..... A47F 7/00

[52] U.S. Cl. ..... 211/4; 211/64

[58] Field of Search ..... 211/4, 64, 8; 70/63; 292/302; 224/1 R, 42.45 R, 42.46 R, 42.43, 42.44; 206/317

[56] References Cited

U.S. PATENT DOCUMENTS

| | | | |
|---|---|---|---|
| 1,951,255 | 3/1934 | Parker | 211/64 |
| 2,070,904 | 2/1937 | Jennings | 211/4 X |
| 2,593,402 | 4/1952 | Aitchison et al. | 211/64 |
| 2,958,422 | 11/1960 | Caloiero et al. | 211/64 X |

*Primary Examiner*—Roy D. Frazier
*Assistant Examiner*—Robert W. Gibson, Jr.
*Attorney, Agent, or Firm*—Clarence A. O'Brien; Harvey B. Jacobson

[57] ABSTRACT

An upstanding rack is provided including upstanding horizontally spaced apart opposite side uprights, horizontal base structure extending between the lower ends of the uprights and a horizontal brace extending between upper portions of the uprights. The base includes structure for supporting the lower butt bends of a plurality of upstanding long guns therefrom at points spaced therealong and the brace includes longitudinally spaced horizontally facing abutment surfaces spaced therealong against which upper end portions of the long guns may be abutted. Horizontally registered portions of the uprights spaced above the base and below the abutment surfaces include support portions and a rigid elongated horizontal support and a lock member is longitudinally removably insertable through one of the support portions toward and into interlocked engagement with the other support portion. An elongated rigid and horizontal shield member is removably receivable between the support portions and includes horizontally aligned opposite end guides through which the support and lock members removably telescopingly received. The shield member defines a laterally outwardly opening cavity therein extending longitudinally thereof and in which the support and lock member is received and the lock member may be lengthwise inserted through the trigger guards of upstanding long guns supported from the base of the rack with the trigger guards of the long guns snugly received within the cavity of the shield member.

10 Claims, 10 Drawing Figures

MACHINE GUN RACK

BACKGROUND OF THE INVENTION

Many organizations including the military utilize racks to support a plurality of long guns in stored condition and most of these racks include structure whereby the long guns supported therefrom are removably locked, at least to some degree, against unauthorized removal of a long gun from the rack. However, theft of long guns from such organizations has been increasing for some time and there is accordingly a great need for a rack in which long guns may be securely locked against all but the most serious attempts at theft.

Various forms of gun racks including some of the general structural and operational features of the instant invention and various forms of locking structure have been heretofore provided. Examples of previously known gun racks are disclosed in U.S. Pat. Nos: 1,951,255, 2,752,046, 2,855,108 and 2,958,422.

BRIEF DESCRIPTION OF THE INVENTION

The gun rack of the instant invention comprises a rack in which a plurality of long guns, such as the M-60 machine gun widely used by the military, may be stored in horizontal rows in upstanding position and with the machine guns securely locked against all but the most serious attempts at theft.

The rack includes a pair of upstanding opposite side uprights through which a horizontally elongated support and lock bar may be longitudinally advanced while being threaded through the trigger guards of the machine guns supported from the rack between the opposite side uprights. As elongated angle member is provided and is receivable between the uprights with the included angle of the angle member defining a recess in which the trigger guards of the machine guns supported from the rack are snugly received. In addition, the angle member includes longitudinally spaced horizontally aligned sleeves through which the support and locking bar may be telescoped with the sleeves being spaced between adjacent machine guns in the rack and those portions of the support and locking bar extending between adjacent sleeves being threaded through the trigger guards of the machine guns. Lock structure is provided and is operatively associated with the support and locking bar and one of the uprights of the rack to removably lock the support and locking bar against longitudinal withdrawal from the upright support portions, the sleeves supported by the angle member and the trigger guard of the machine guns in the rack. By this construction, the support and locking bar securely locks the machine guns in position within the rack and is embracingly received within the included angle defined by the angle member in order that the support and locking member will be shielded against effective cutting action thereon by a bolt cutter or metal cutting saw.

The main object of this invention is to provide a rack for long guns and which will be capable of supporting a plurality of long guns in upstanding position and in a removably locked manner against unauthorized removal from the rack.

Another object of this invention, in accordance with the immediately preceding object, is to provide a gun rack specifically designed for use in conjunction with M-60 machine guns.

Another important object of this invention is to provide a gun rack which will be capable of supporting a plurality of long guns in a manner offering considerable protection to the long guns against accidental damage thereto.

A final object of this invention to be specifically enumerated herein is to provide a gun rack in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
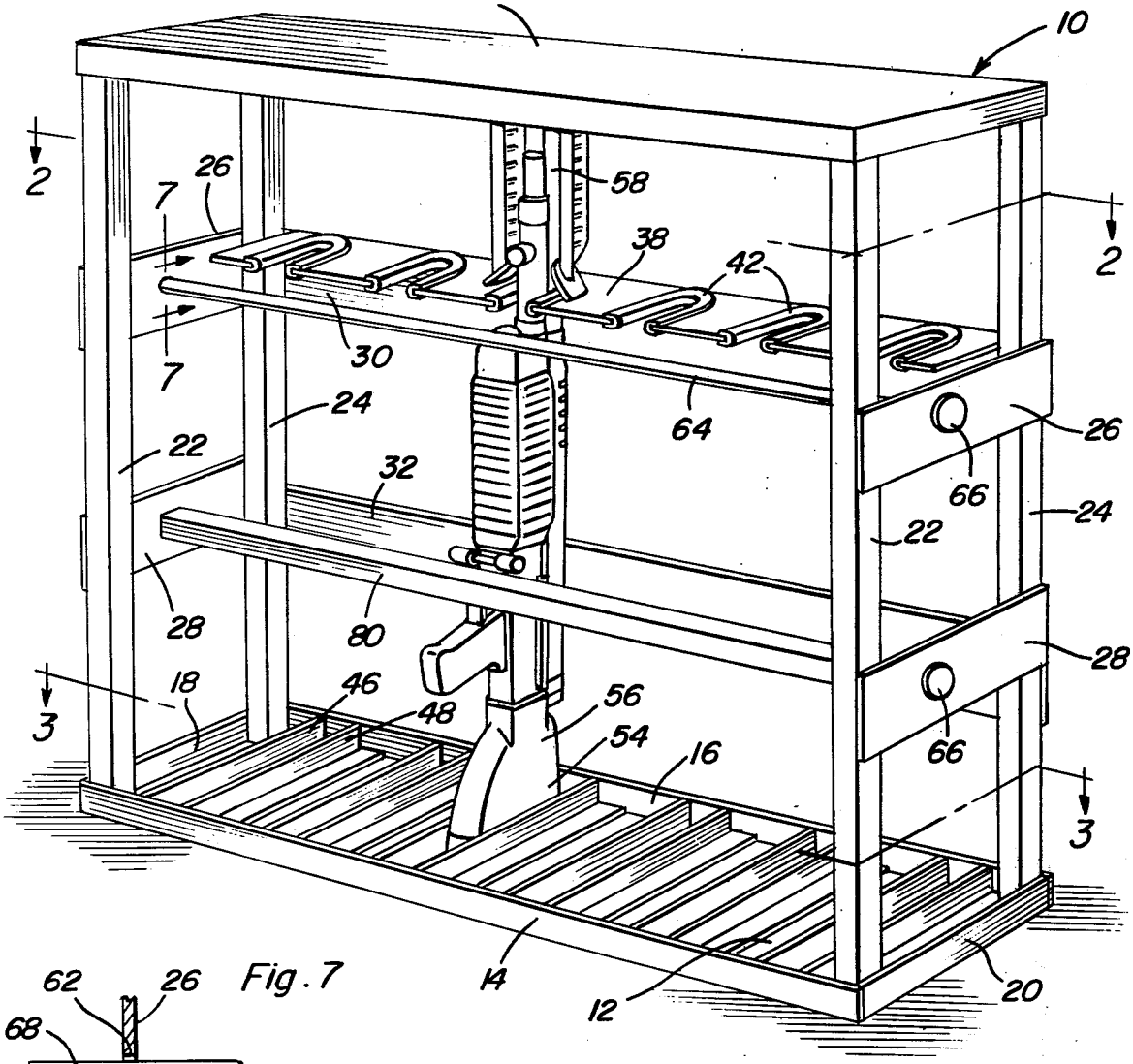
FIG. 1 is a perspective view of the gun rack with a single machine gun supported therefrom in upstanding position and with the rack locked against unauthorized removal of the machine gun.
Figure 7:
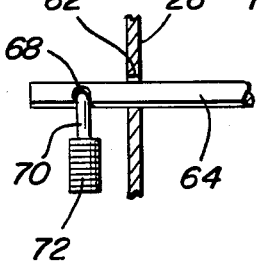
FIG. 7 is an enlarged fragmentary vertical sectional view taken substantially upon the plane indicated by the section line 7—7 of FIG. 1.

Referring now more specifically to the drawings, the numeral 10 generally designates the rack of the instant invention. The rack 10 includes a horizontal base 12 including upstanding front and rear longitudinal flanges 14 and 16 and opposite end flanges 18 and 20. Pairs of opposite end front and rear standards 22 and 24 are supported and project upwardly from the base 12 and each pair of standards 22 and 24 is interconnected by means of a pair of upper and lower front to rear extending brace members 26 and 28 extending and secured therebetween. In addition, upper and lower rear brace members 30 and 32 extend and are secured between the rear standards 24 and a downwardly opening top structure 34 is telescoped downwardly over and is secured to the upper ends of the standards 22 and 24.

In addition to the upper brace member 30, an angle member 34 including a vertical flange 36 and a horizontally forwardly projecting upper flange 38 is secured to the brace member 30 with the vertical flange 36 overlapping the rear side of the brace member 30 and the horizontal flange 38 extending over and projecting forwardly of the upper marginal edge of the brace member 30. The flange 38 includes a plurality of longitudinally spaced forwardly opening notches 40 formed therein and each notch 40 is lined by a resilient U-shaped cushion 42 having an outer peripheral groove 44 formed therein in which the portions of the flange 38 defining the corresponding notch 40 is seated.

The base 12 includes pairs of oppositely opening angle members 46 and 48 secured between longitudinally spaced portions of the flanges 14 and 16 and to the base 12 and an upwardly opening recess 50 is defined between each pair of angle members 46 and 48, the recesses 50 being vertically registered with the notches 40.

Figure 2:
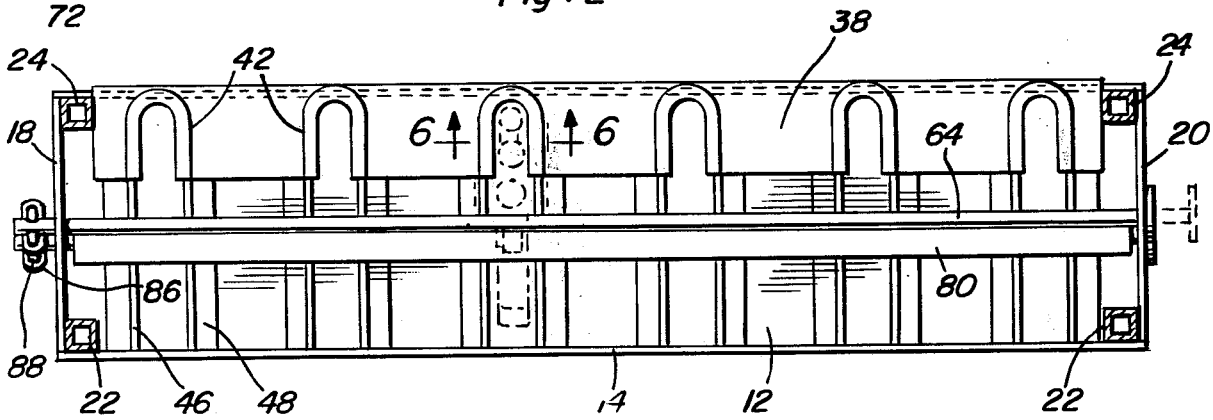
FIG. 2 is an enlarged horizontal sectional view taken substantially upon the plane indicated by the section line 2—2 of FIG. 1 and with the machine gun illustrated in phantom lines.
Figure 3:
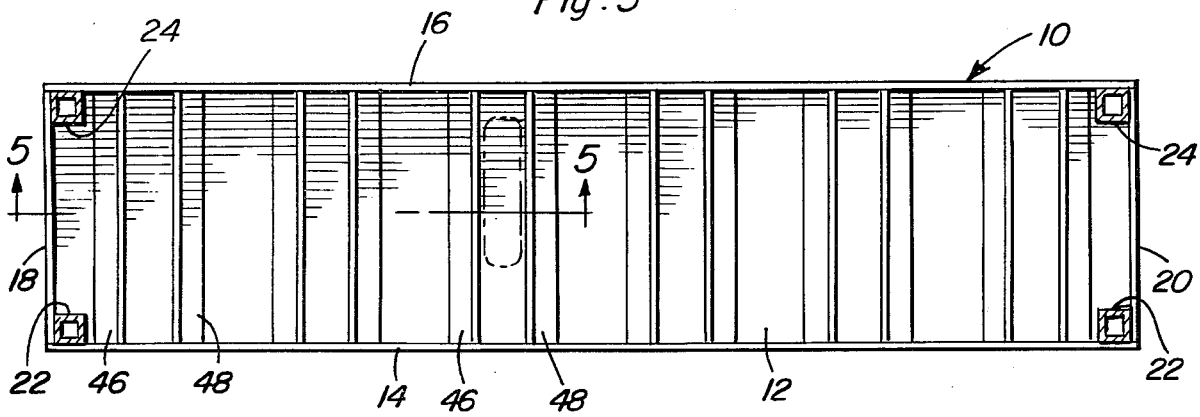
FIG. 3 is an enlarged horizontal sectional view taken substantially upon the plance indicated by the section line 3—3 of FIG. 1.

With attention now invited more specifically to FIGS. 1 and 2 of the drawings, it may be seen that an M-60 machine gune 52 may have the butt end 54 of the stock 56 thereof received in one of the recesses 50 and the barrel 58 thereof received in one of the notches 40 against the cushion 42 with the trigger guard 60 of the machine gune 52 in horizontal registry with the brace members 28.

The brace members 26 and the brace members 28 have aligned bores 62 formed therethrough and a locking bar 64 is inserted through the aligned bores 62 in the brace members 26 and has a diametrically enlarged head 66 on one end thereof abuttingly engageable with the outer surface of the corresponding brace member. The other end of the locking rod 64 has a diametric bore 68 formed therethrough immediately outwardly of the bore 62 formed in the other brace member 26 and the hasp 70 of a padlock 72 is passed through the bore 68 in order to releasably lock the bar 64 through the bores 62 formed in the brace members 26, the locking rod 64 passing closely forward of the upper extremity of the upper portion of the stock 76 of the machine gune 52 in general horizontal registry with the flange 38.

The trigger guard 60 loosely encloses the trigger 78 of the machine gun 52 and a second locking bar 64 is passed through the bores 62 in the brace members 28 and through the trigger guard 60 immediately above the trigger 78. Also, an elongated rigid and horizontal shield member 80 in the form of an angle member is provided and is receivable between the adjacent sides of the brace members 28 prior to insertion of the lower locking rod 64 through the bores 62 formed in the lower brace members 28. The angle member 80 includes longitudinally spaced thick walled sleeves 82 and 84 secured in the laterally outwardly opening side of the angle member 80 and the trigger guards 60 of machine guns 52 supported from the rack 10 are receivable between adjacent sleeves 82 and 84 and snugly embraced by the angle member 80, see FIG. 4, prior to the lower locking rod 64 being longitudinally inserted through the bores 62 formed in the brace members 28, the lower locking rod 64 being insertable through the sleeves 82 and 84. After the angle member 80 has been positioned in the manner illustrated in FIG. 4 of the drawings and the lower locking rod 64 has been inserted through the bores 62 formed through the lower brace members 28 and also through the sleeves 82 and 84 and the trigger guard 60, a second lock 86 has its hasp 88 passed through the bore 68 formed in the second locking rod 64. In this manner, with the angle member 80 snugly received between the lower brace members 28, the lower locking rod 64 is completely protected against cutting action thereon by conventional bolt cutters. If it is desired, the extended ends of the locking rod 64 through which the hasps 70 and 88 are passed may be enclosed within thick walled sleeves (not shown) through which the hasps 70 and 88 also pass and the locks 72 and 68 may be enclosed within a removable and lockable housing (not shown).

Figure 4:
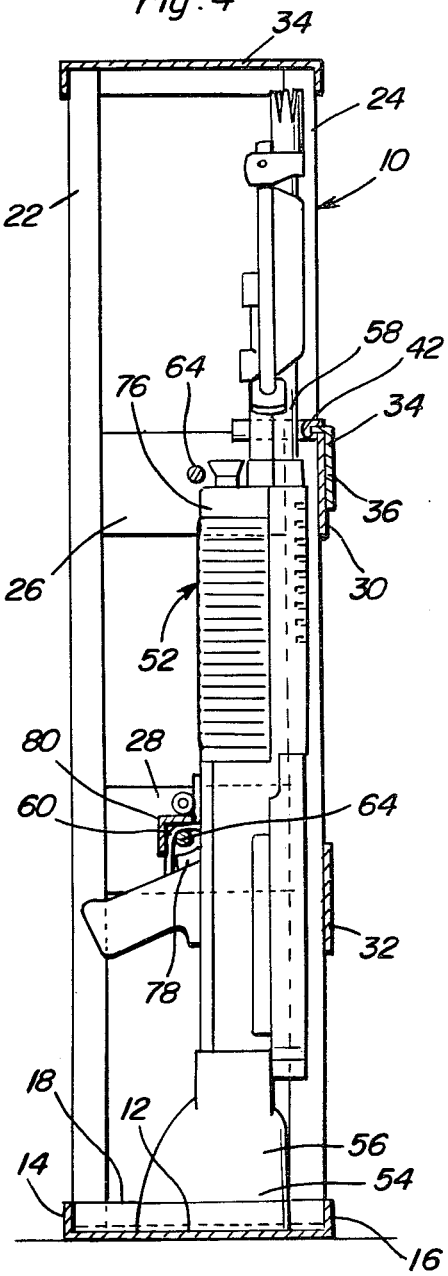
FIG. 4 is an enlarged vertical sectional view taken substantially upon a plane passing through that portion of the rack of FIG. 1 in which the machine gun is supported and as seen from the right side of FIG. 1.
Figure 5:
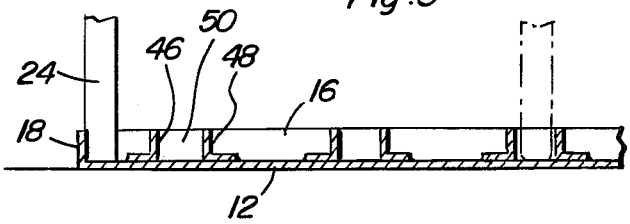
FIG. 5 is a fragmentary vertical sectional view taken substantially upon the plane indicated by the section line 5—5 of FIG. 3.
Figure 6:
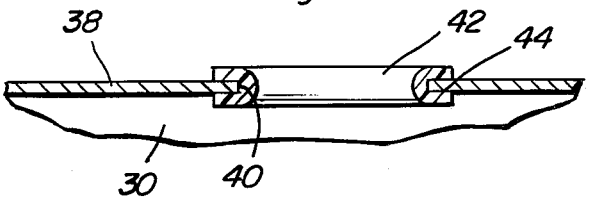
FIG. 6 is an enlarged fragmentary vertical sectional view taken substantially upon the plane indicated by the section line 6—6 of FIG. 2.
Figure 8:
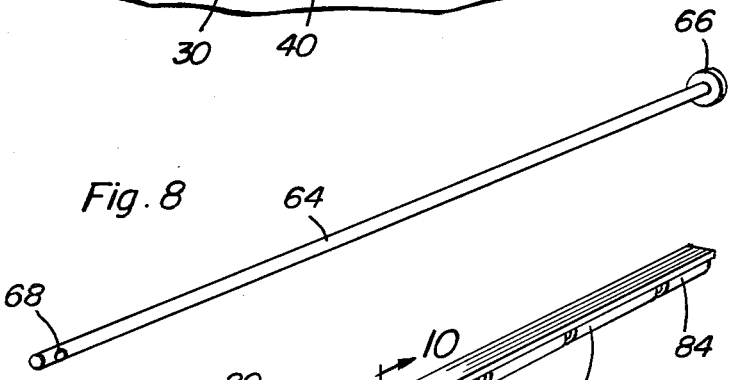
FIG. 8 is a perspective view of the support and locking bar of the gun rack.
Figure 9:
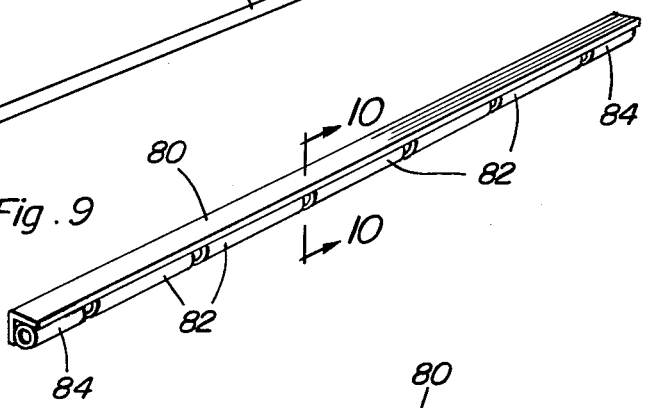
FIG. 9 is a perspective view of the elongated horizontal shield member for the support and lock member.
Figure 10:
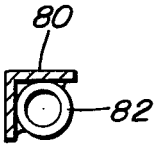
FIG. 10 is an enlarged fragmentary vertical sectional view taken substantially upon the plane indicated by the section line 10—10 of FIG. 9.

After the locking rods 64 and the angle member 80 have been installed in the manner illustrated in FIGS. 1, 2 and 4 of the drawings, it is substantially impossible for the machine gun 52 to be removed in an unauthorized manner.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A rack for supporting a long gun of the type including a barrel, a stock projecting rearwardly of the barrel and a trigger guard frame loosely enclosing a trigger and defining a transverse passage therethrough forward of said trigger, said rack including upwardly facing base means upon which the butt end of the stock of said long gun may be supported with said gun in upstanding muzzle end up position, a pair of side uprights projecting upwardly from said base means in horizontally spaced relation, a horizontal brace extending between and supported from said uprights, said brace including means defining an abutment surface facing in a horizontal direction generally normal to a line extending between said uprights, said uprights including means defining horizontally aligned support portions, above said base means and below said abutment surface, a rigid elongated horizontal support and lock member longitudinally removably insertable through one of said support portions toward and into interlocked engagement with the other support portion, and an elongated rigid and horizontal shield member removably receivable between said support portions and including horizontally aligned opposite end guides through which said support and lock member is removably telescopingly received, said shield member defining a laterally outwardly opening cavity therein extending longitudinally thereof and in which said support and lock member is received, said lock member being adapted to be lengthwise threaded through said trigger guard upon lengthwise advance of said lock member through said one support member toward and into interlocked engagement with said other support portion, said cavity being adapted to snugly received said trigger guard therein, and lock means removably operatively associated with said support and lock member and one of said support portions to prevent lengthwise withdrawal of said support and lock member from said support portions.

2. The combination of claim 1 including a long gun supported from said base in upstanding muzzle end up position and with an upper portion of said long gun disposed closely juxtaposed said abutment surface and a trigger guard of said long gun disposed between and aligned with said support portions, said support and lock member being passed through said trigger guard and the latter being snugly received in said cavity between said opposite end guides.

3. The combination of claim 1 wherein said base means includes means defining a plurality of upwardly opening recesses spaced apart between said uprights, said brace including a plurality of said abutment surfaces spaced therealong in substantial vertical registry with said recesses, and said shield member including a plurality of guides supported therefrom spaced intermediate said opposite end guides, the spacing between adjacent guides being vertically registered with said recesses.

4. The combination of claim 1 wherein said support and lock member comprises an elongated rod, said guides comprising sleeves secured in said cavity.

5. The combination of claim 4 wherein said shield member comprises an angle member, the included angle corner formed by said angle members comprising said cavity.

6. The combination of claim 5 wherein said base means includes means defining a plurality of upwardly opening recesses spaced apart between said uprights, said brace including a plurality of said abutment surfaces spaced therealong in substantial vertical registry with said recesses, and said shield member including a plurality of guides supported therefrom spaced intermediate said opposite end guides, the spacing between adjacent guides being vertically registered with said recesses.

7. The combination of claim 5 wherein said means defining said abutment surface comprises a horizontally outwardly opening notch formed in said brace member.

8. In combination with a gun rack including guide defining opposite side portions and adapted to support a row of upstanding long guns therein between said side portions with the trigger guards of said guns aligned in a path extending between said side portions in predetermined position relative to said rack, an elongated rigid support and lock member longitudinally and slidingly received through one of said side portions, said trigger guards and interlockingly engaged with the other of said side portions, an elongated rigid shield member defining a laterally outwardly opening cavity extending longitudinally thereof, said shield member being snugly lengthwise received between said side portions, a plurality of aligned guides spaced along and secured in said cavity, said shield member being positioned with said guides disposed along said path, said trigger guards received in said cavity between pairs of adjacent sleeves and said support and lock member being also received through said trigger guards with said support and lock member embraced by said shield member.

9. The combination of claim 8 wherein said shield member comprises an angle member, the included angle corner formed by said angle members comprising said cavity.

10. The combination of claim 9 wherein said support and lock member comprises an elongated rod, said guides comprising sleeves secured in said cavity.

* * * * *